US010328702B2

(12) United States Patent
Sonobata

(10) Patent No.: US 10,328,702 B2
(45) Date of Patent: Jun. 25, 2019

(54) NOZZLE PLATE, LIQUID EJECTION HEAD USING SAME, AND RECORDING DEVICE

(71) Applicant: KYOCERA Corporation, Kyoto-shi, Kyoto (JP)

(72) Inventor: Hidetaka Sonobata, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 15/748,963

(22) PCT Filed: Jul. 28, 2016

(86) PCT No.: PCT/JP2016/072169

§ 371 (c)(1),
(2) Date: Jan. 30, 2018

(87) PCT Pub. No.: WO2017/018485

PCT Pub. Date: Feb. 2, 2017

(65) Prior Publication Data

US 2019/0001682 A1 Jan. 3, 2019

(30) Foreign Application Priority Data

Jul. 30, 2015 (JP) ..... 2015-150911

(51) Int. Cl.
*B41J 2/14* (2006.01)
*B41J 2/16* (2006.01)

(52) U.S. Cl.
CPC ..... *B41J 2/1631* (2013.01); *B41J 2/1433* (2013.01); *B41J 2/14209* (2013.01); *B41J 2/162* (2013.01); *B41J 2002/14475* (2013.01)

(58) Field of Classification Search
CPC .... B41J 2/1631; B41J 2/14209; B41J 2/1433; B41J 2/162
See application file for complete search history.

(56) References Cited

U.S. PATENT DOCUMENTS 6,592,206 B1 7/2003 Suzuki et al.
2005/0253488 A1* 11/2005 Ito ..... B41J 2/14209 310/366

(Continued)

FOREIGN PATENT DOCUMENTS

JP 04-348948 A 12/1992
JP 2001-187451 A 7/2001

(Continued)

OTHER PUBLICATIONS

International Search Report, PCT/JP2016/072169, dated Oct. 4, 2016, 2 pgs.

*Primary Examiner* — Jason S Uhlenhake
(74) *Attorney, Agent, or Firm* — Volpe and Koenig, P.C.

(57) ABSTRACT

A nozzle plate includes a first surface, a second surface opposite the first surface, and a plurality of through holes which penetrate through the plate from the first surface to the second surface and become nozzles. Each of the through holes includes, on at least the first surface side forming the side where the liquid is ejected, an inversely tapered part having a cross-sectional area becoming larger toward the first surface. The first surface includes a first region and a second region which is not superimposed on the first region. A first through hole of one the through holes is arranged in the first region, a second through hole of one the through holes is arranged in the second region. When viewed from the first surface the width of the inversely tapered part in the first through hole is larger than the inversely tapered part in the second through hole.

7 Claims, 7 Drawing Sheets

(56) References Cited

U.S. PATENT DOCUMENTS

| | | | | |
|---|---|---|---|---|
| 2006/0187259 | A1 | 8/2006 | Kojima | |
| 2014/0118445 | A1* | 5/2014 | Ikeuchi | B41J 2/155 347/68 |
| 2015/0224766 | A1* | 8/2015 | Kawamura | B41J 2/14209 347/9 |

FOREIGN PATENT DOCUMENTS

| | | | |
|---|---|---|---|
| JP | 2006-175678 | A | 7/2006 |
| JP | 2006-231626 | A | 9/2006 |
| JP | 2012-179720 | A | 9/2012 |

* cited by examiner

NOZZLE PLATE, LIQUID EJECTION HEAD USING SAME, AND RECORDING DEVICE

TECHNICAL FIELD

The present disclosure relates to a nozzle plate, a liquid ejection head using the same, and a recording device.

BACKGROUND ART

Known in the art is a method for preparing a nozzle plate used in a liquid ejection head, including exposing a resin reacting with respect to light to prepare a matrix corresponding to a shape of a nozzle, forming a metal plating layer on the periphery of the matrix, and peeling off the metal plating layer (for example see Patent Literature 1).

CITATION LIST

Patent Literature

Patent Literature 1: Japanese Patent Publication No. 2006-175678A

SUMMARY OF INVENTION

A nozzle plate of the present disclosure includes a first surface, a second surface on the opposite side to the first surface, and a plurality of through holes which penetrate through the plate from the first surface to the second surface and become nozzles. Each of the through holes includes, on at least the first surface side forming the side where the liquid is ejected, an inversely tapered part having a cross-sectional area becoming larger toward the first surface. The first surface includes a first region and a second region which is not superimposed on the first region. A first through hole of one the through holes is arranged in the first region. A second through hole of one the through holes is arranged in the second region. When defining the width of the inversely tapered part when viewed from the first surface side as "T", the width T of the inversely tapered part in the first through hole is larger than the width T of the inversely tapered part in the second through hole. A thickness of the nozzle plate in the first region is thinner than a thickness of the nozzle plate in the second region.

Further, a liquid ejection head of the present disclosure includes the nozzle plate, a plurality of pressurizing chambers which are individually linked with the plurality of through holes, and a plurality of pressurizing parts for applying pressure to the plurality of pressurizing chambers.

Further, a recording device of the present disclosure includes the liquid ejection head, a conveying part for conveying a recording medium with respect to the liquid ejection head, and a control part which controls the liquid ejection head.

DESCRIPTION OF EMBODIMENTS

Figure 1A:
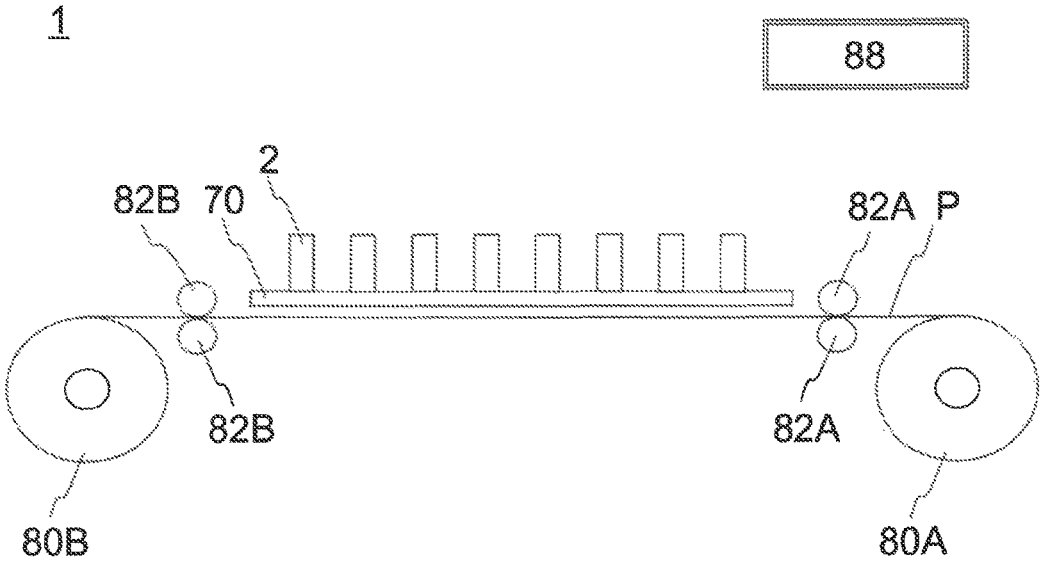
FIG. 1A is a side view of a recording device including a liquid ejection head according to an embodiment of the present disclosure.
Figure 1B:
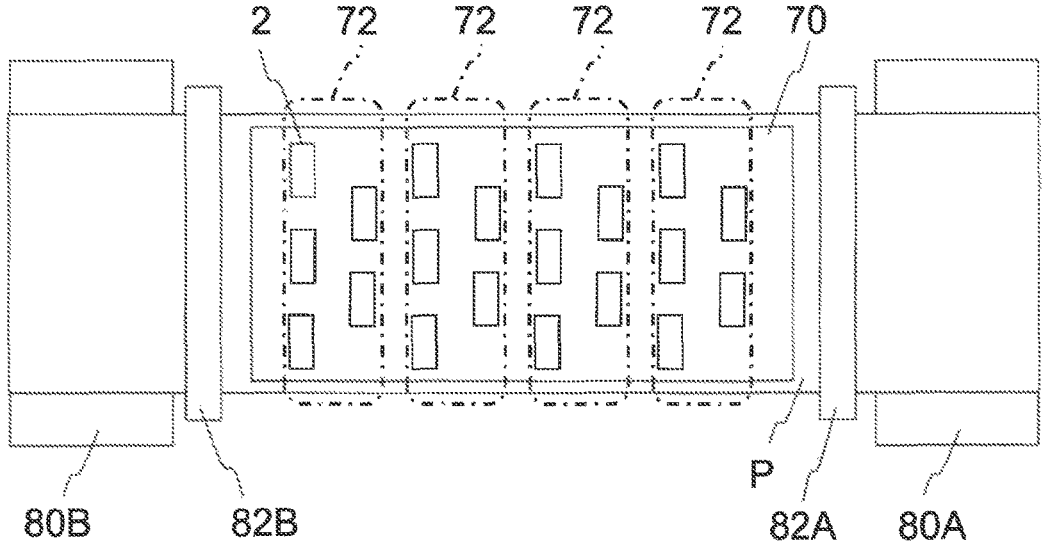
FIG. 1B is a plan view.

FIG. 1A is a schematic side view of a recording device including liquid ejection heads 2 according to an embodiment of the present disclosure as constituted by a color inkjet printer 1 (below, sometimes simply referred to as a "printer"), and FIG. 1B is a schematic plan view. The printer 1 conveys a recording medium of the printing paper P from guide rollers 82A to conveying rollers 82B to thereby make the printing paper P move relative to the liquid ejection heads 2. A control part 88 controls the liquid ejection heads 2 based on image or text data to make them eject liquid toward the printing paper P and shoot droplets onto the printing paper P to thereby perform recording such as printing on the printing paper P.

In the present embodiment, the liquid ejection heads 2 are fixed with respect to the printer 1, so the printer 1 becomes a so-called line printer. As another embodiment of the recording device of the present invention, there can be mentioned a so-called serial printer which alternately performs an operation of moving the liquid ejection heads 2 to reciprocate or the like in a direction crossing the conveying direction of the printing paper P, for example, a substantially perpendicular direction, and conveyance of the printing paper P.

To the printer 1, a plate-shaped head mounting frame 70 (below, sometimes simply referred to as a "frame") is fixed so that it becomes substantially parallel to the printing paper P. The frame 70 is provided with not shown 20 holes. Twenty liquid ejection heads 2 are mounted in the hole portions. The portions of the liquid ejection heads 2 which eject the liquid face the printing paper P. A distance between the liquid ejection heads 2 and the printing paper P is set to for example about 0.5 to 20 mm. Five liquid ejection heads 2 configure one head group 72. The printer 1 has four head groups 72.

A liquid ejection head 2 has a long shaped elongated in a direction from the front to the inside in FIG. 1A and in the up-down direction in FIG. 1B. This long direction will be sometimes called as the "longitudinal direction". In one head group 72, three liquid ejection heads 2 are aligned in a direction crossing the conveying direction of the printing paper P, for example, a substantially perpendicular direction. The other two liquid ejection heads 2 are aligned at positions offset along the conveying direction so that each is arranged between two among the three liquid ejection heads 2. The liquid ejection heads 2 are arranged so that ranges which can be printed by the liquid ejection heads 2 are connected in the width direction of the printing paper P (in the direction crossing the conveying direction of the printing paper P) or the ends overlap each other, therefore printing without a gap becomes possible in the width direction of the recording medium P.

The four head groups 72 are arranged along the conveying direction of the printing paper P. To each liquid ejection head 2, a liquid, for example, ink, is supplied from a not shown liquid tank. To the liquid ejection heads 2 belonging to one head group 72, ink of the same color is supplied. Inks of four colors can be printed by the four head groups 72. The colors of inks ejected from the head groups 72 are for example magenta (M), yellow (Y), cyan (C), and black (K). If printing such inks is carried out by controlling by the control part 88, color images can be printed.

The number of liquid ejection heads 2 mounted in the printer 1 may be one as well so far as printing is carried out for a range which can be printed by one liquid ejection head 2 in a single color. The number of liquid ejection heads 2 included in the head group 72 or the number of head groups 72 can be suitably changed according to the target of printing or printing conditions. For example, the number of head groups 72 may be increased as well in order to perform printing by further multiple colors. Further, if a plurality of head groups 72 for printing in the same color are arranged and printing is alternately carried out in the conveying direction, the conveying speed can be made faster even if liquid ejection heads 2 having the same performances are used. Due to this, the printing area per time can be made larger. Further, it is also possible to raise the resolution in the width direction of the printing paper P by preparing a plurality of head groups 2 for printing in the same color and arranging them offset in a direction crossing the conveying direction.

Further, other than printing colored inks, a coating agent or other liquid may be printed as well in order to treat the surface of the printing paper P.

The printer 1 performs printing on the recording medium of the printing paper P. The printing paper P is wound around the paper feed roller 80A. After passing between the two guide rollers 82A, it passes under the liquid ejection heads 2 mounted in the frame 70. After that, it passes between the two conveying rollers 82B and is finally collected by the collection roller 80B. When printing, by rotation of the conveying rollers 82B, the printing paper P is conveyed at a constant speed, and printing is carried out by the liquid ejection heads 2. The collection roller 80B takes up the printing paper P fed out from the conveying rollers 82B. The conveying speed is set to for example 75 m/min. Each roller may be controlled by the control part 88 or may be operated manually by a person.

The recording medium may be a roll of fabric or the like other than printing paper P. Further, the printer 1, in place of directly conveying the printing paper P, may directly convey a conveyor belt and carry the recording medium on the conveyor belt to convey it. When performing this, a sheet, cut fabric, wood, tile, etc. can be used as the recording medium. Further, a liquid containing conductive particles may be ejected from the liquid ejection heads 2 to print a wiring pattern etc. of an electronic apparatus as well. Furthermore, predetermined amounts of liquid chemical agents or liquids containing chemical agents may be ejected from the liquid ejection heads 2 toward a reaction vessel or the like to cause a reaction etc. and thereby prepare pharmaceutical products.

Further, a position sensor, speed sensor, temperature sensor, and the like may be attached to the printer 1, and the control part 88 may control the portions in the printer 1 in accordance with the states of the portions in the printer 1 seen from the information from the sensors. For example, when the temperature of the liquid ejection heads 2 or temperature of the liquid in the liquid tank, the pressure applied by the liquid in the liquid tank to the liquid ejection heads 2, and so on exert an influence upon the ejection amount, ejection speed, and other ejection characteristics of the ejected liquid, a driving signal for ejecting the liquid may be changed in accordance with that information as well.

Figure 2:
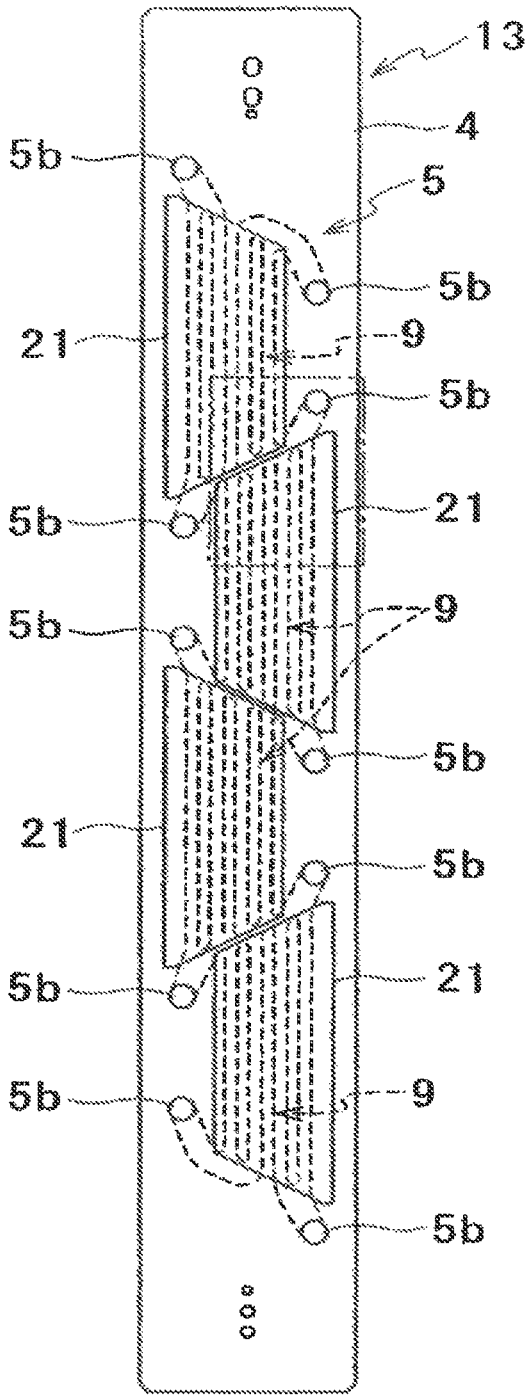
FIG. 2 A plan view of a head body forming part of the liquid ejection head in FIGS. 1A and 1B.
Figure 3:
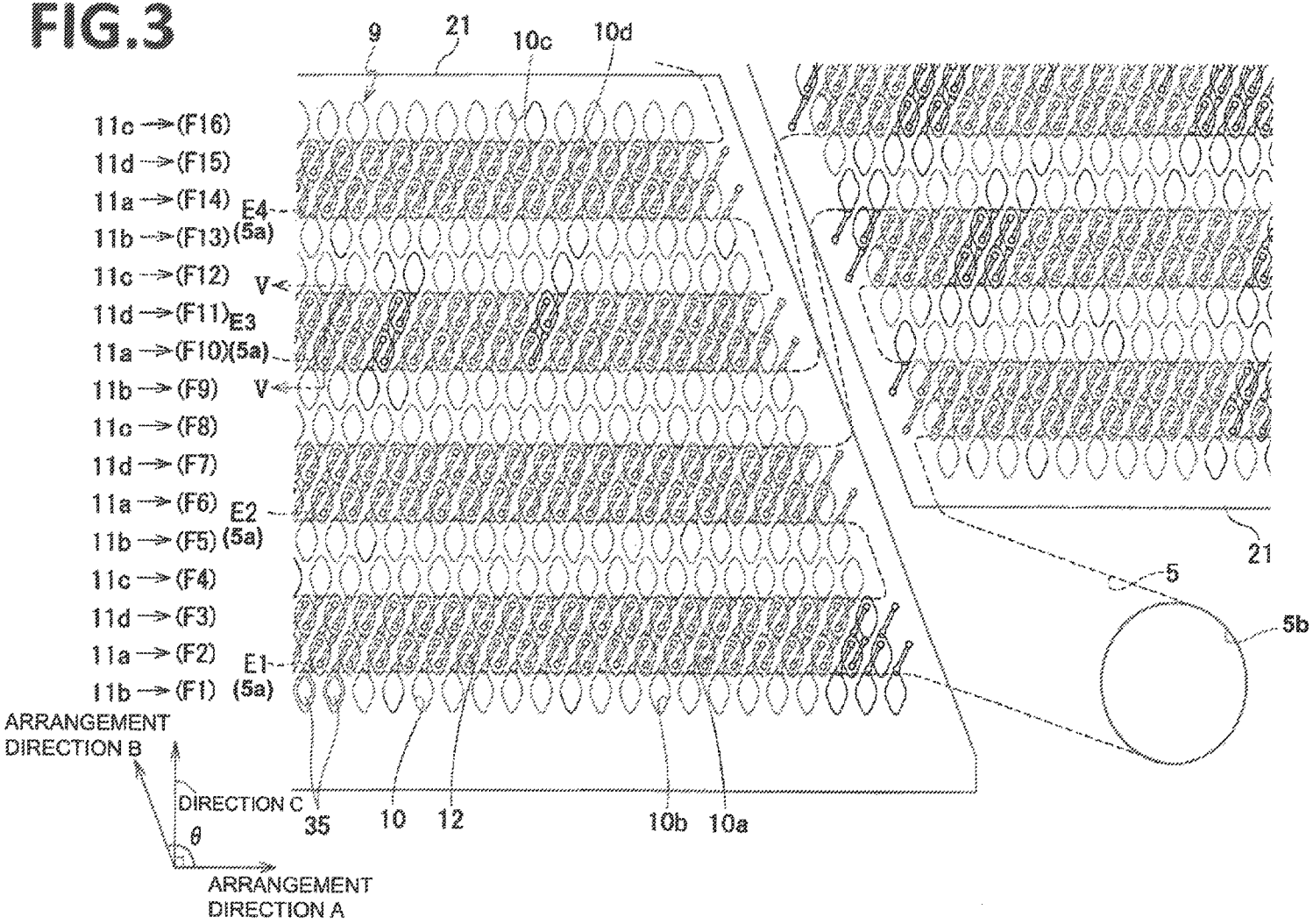
FIG. 3 An enlarged view of a region surrounded by a one-dot chain line in FIG. 2 and a plan view after omitting part of the channels for explanatory purposes.
Figure 4:
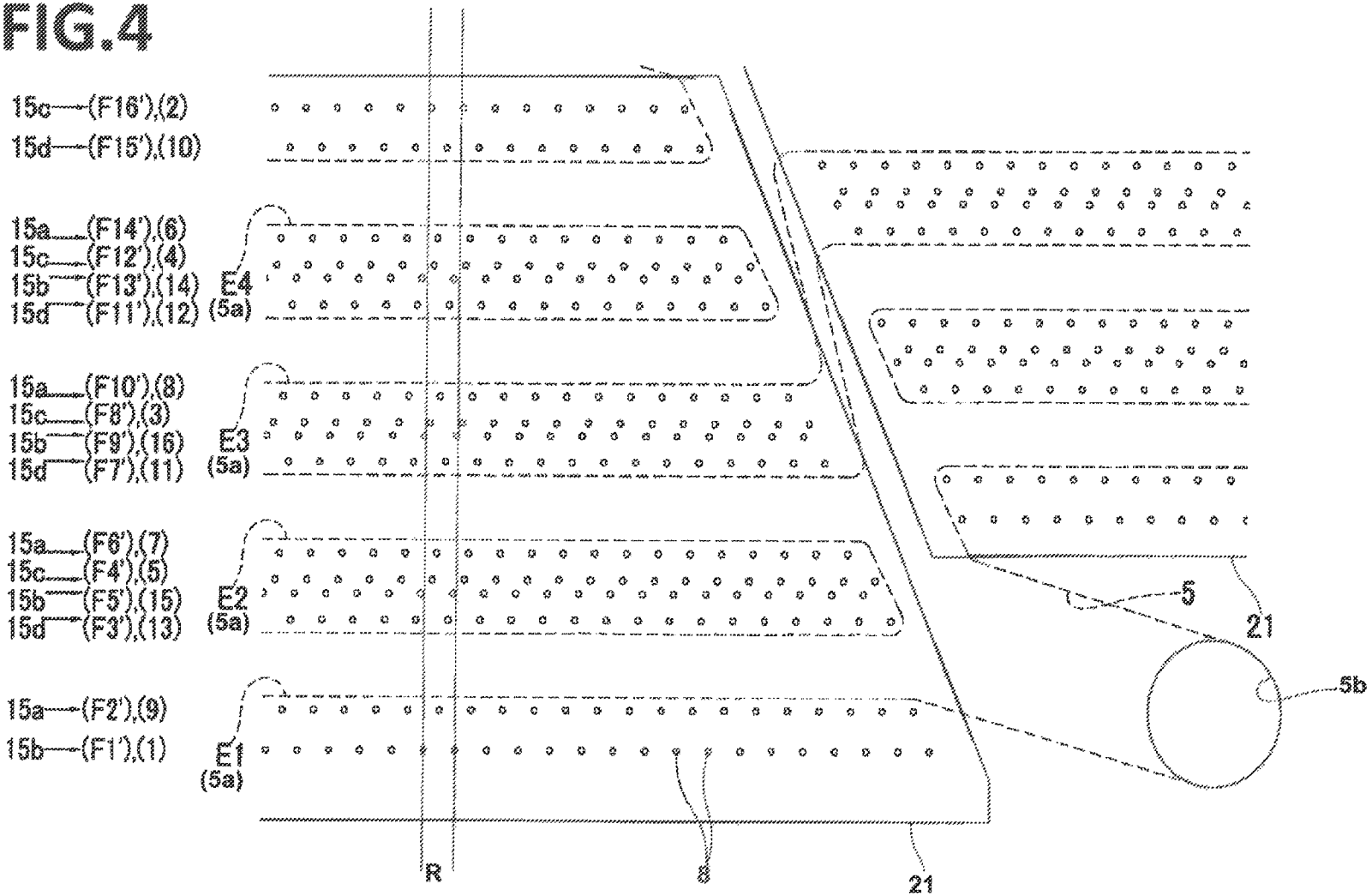
FIG. 4 An enlarged view of a region surrounded by a one-dot chain line in FIG. 2 and a plan view after omitting part of the channels for explanatory purposes.
Figure 5A:
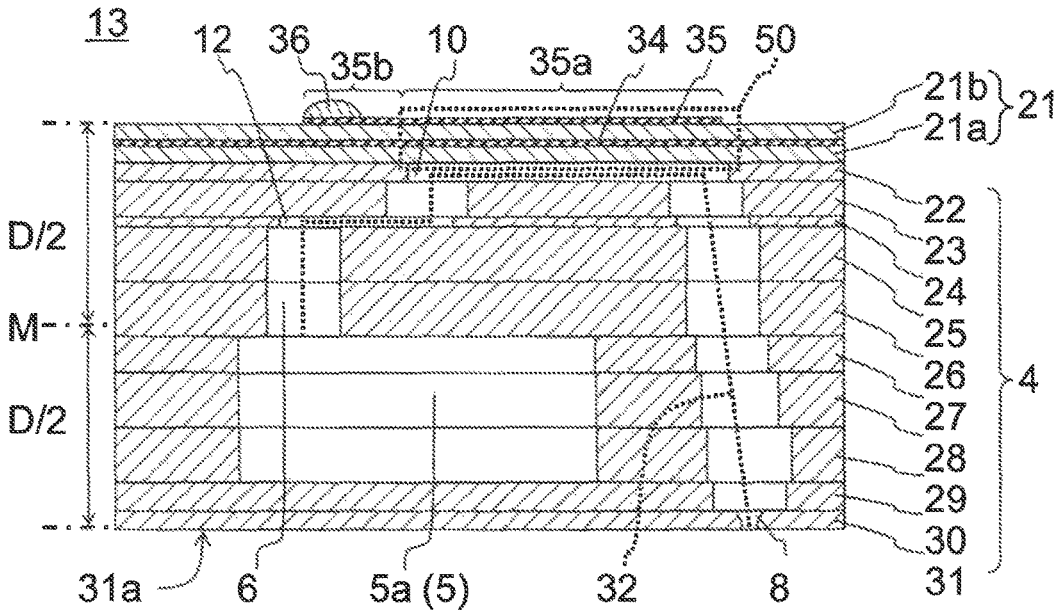
FIG. 5A is a vertical cross-sectional view along the V-V line in FIG. 3.
Figure 5B:
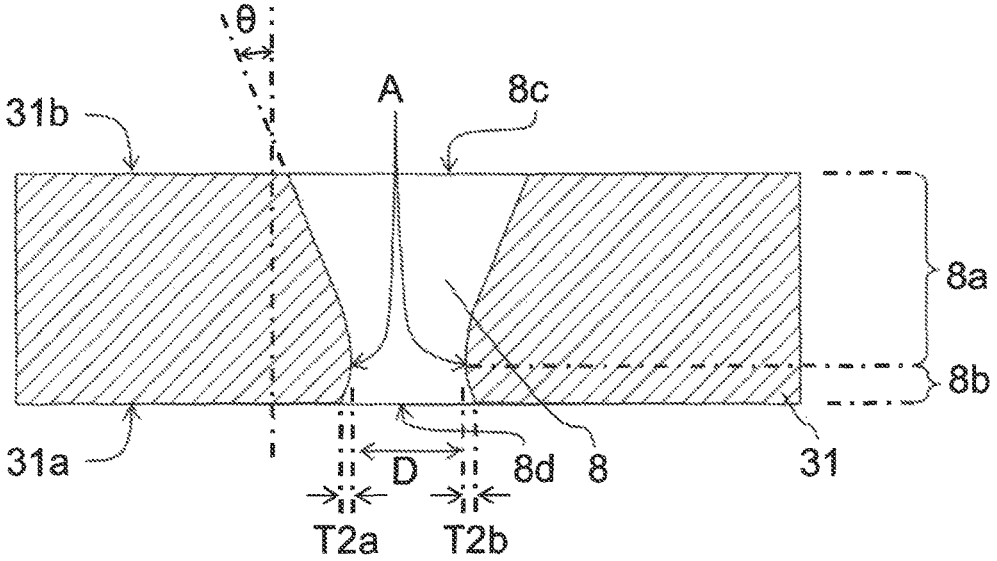
FIG. 5B is an enlarged vertical cross-sectional view of a nozzle 8 in FIG. 5A.
Figure 6A:
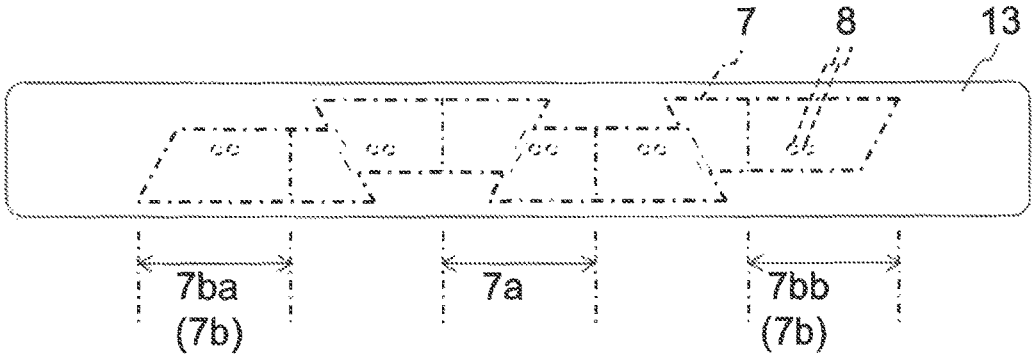
FIG. 6 is a plan view of the head body.
FIG. 6B is an enlarged plan view when viewing a nozzle from an ejection hole side.
Figure 6B:
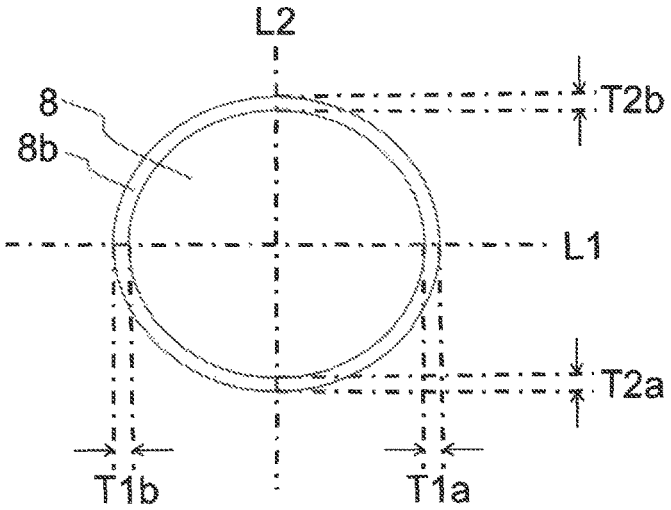

Next, a liquid ejection head 2 according to an embodiment of the present disclosure will be explained. FIG. 2 is a plan view showing a head body 13 forming a principal part of a liquid ejection head 2 shown in FIGS. 1A and 1B. FIG. 3 is an enlarged plan view of a region surrounded by a one-dot chain line in FIG. 2 and a view showing a portion of the head body 13. FIG. 4 is an enlarged view of the same position as FIG. 3. FIG. 3 and FIG. 4 are drawn while omitting part of the channels for facilitating understanding of the drawings. Further, in FIG. 3 and FIG. 4, for facilitating understanding of the drawings, the pressurizing chambers 10, apertures 12, nozzles 8, etc. which are located below piezoelectric actuator substrates 21 and so should be drawn by broken lines are drawn by solid lines. FIG. 5A is a vertical cross-sectional view along the V-V line in FIG. 3, while FIG. 5B is an enlarged vertical cross-sectional view of a nozzle 8. FIG. 6A is a plan view of the head body 13, and FIG. 6B is an enlarged plan view when viewing the nozzle 8 located at the position of B in FIG. 6A from the ejection hole 8*d* side.

The head body 13 has a plate-shaped channel member 4 and piezoelectric actuator substrates 21 on the channel member 4. The channel member 4 is made by stacking a nozzle plate 31 having nozzles 8 and a channel member body formed by stacking plates 22 to 30. The piezoelectric actuator substrates 21 have trapezoidal shapes and are arranged on the upper surface of the channel member 4 so that pairs of parallel facing sides of the trapezoids become parallel to the longitudinal direction of the channel member 4. Further, along each of two virtual straight lines which are parallel to the longitudinal direction of the channel member 4, two each piezoelectric actuator substrates 21 are arranged, that is, a total of four are arranged on the channel member 4 in a zigzag manner as a whole. Slanted sides of the piezoelectric actuator substrates 21 which are adjacent to each other on the channel member 4 partially overlap in the traverse direction of the channel member 4. In a region printed by driving the piezoelectric actuator substrates 21 in these overlapped portions, the droplets ejected by the two piezoelectric actuator substrates 21 are shot while mixed.

Inside the channel member 4, manifolds 5 are formed as parts of the liquid channel. The manifolds 5 have elongated shapes extending along the longitudinal direction of the channel member 4. Openings 5*b* of the manifolds 5 are formed in the upper surface of the channel member 4. There are 10 openings 5*b*. Five each are formed along the two straight lines which are parallel to the longitudinal direction of the channel member 4. The openings 5*b* are formed at positions avoiding the region in which the four piezoelectric actuator substrates 21 are arranged. Into the manifolds 5, liquid is supplied through the openings 5*b* from a not shown liquid tank.

Each manifold 5 formed in the channel member 4 is branched into a plurality of parts (a branched part of a manifold 5 will be sometimes referred to as a "sub-manifold 5*a*"). The manifold 5 linked with an opening 5*b* extends so as to be run along a slanted side of a piezoelectric actuator substrate 21 and is arranged so as to cross the longitudinal direction of the channel member 4. In a region sandwiched between two piezoelectric actuator substrates 21, one manifold 5 is shared by adjoining piezoelectric actuator substrates 21. Sub-manifolds 5*a* are branched from the two sides of the manifold 5. These sub-manifolds 5*a* extend in the longitudinal direction of the head body 13 so that they are adjacent to each other in regions facing the piezoelectric actuator substrates 21 inside the channel member 4.

The channel member 4 has four pressurizing chamber groups 9 in which pluralities of pressurizing chambers 10 are formed in matrices (that is two-dimensionally and regularly). A pressurizing chamber 10 is a hollow region having a substantially diamond shaped planar shape having rounded corner portions. The pressurizing chamber 10 is formed so as to open in the upper surface of the channel member 4. These pressurizing chambers 10 are arranged over substantially the entire surfaces of the regions facing the piezoelectric actuator substrates 21 at the upper surface of the channel member 4. Accordingly, each pressurizing chamber group 9 formed by these pressurizing chambers 10 occupies a region having substantially the same size and shape as those of a piezoelectric actuator substrate 21. Further, the opening of each pressurizing chamber 10 is closed by bonding the piezoelectric actuator substrate 21 to the upper surface of the channel member 4.

In the present embodiment, as shown in FIG. 3, each manifold 5 is branched into four lines of E1 to E4 sub-manifolds 5*a* arranged in the transverse direction of the channel member 4 parallel to each other. The pressurizing chambers 10 linked with each sub-manifold 5*a* configure a column of the pressurizing chambers 10 arranged at equal intervals in the longitudinal direction of the channel member 4. Four of those columns are arranged in the transverse direction in parallel to each other. On the two sides of each sub-manifold 5*a*, two columns each of pressurizing chambers 10 linked with the sub-manifold 5*a* are arranged.

Overall, the pressurizing chambers 10 connected from a manifold 5 configure columns of pressurizing chambers 10 which are arranged at equal intervals in the longitudinal direction of the channel member 4. Sixteen of those columns are arranged in the transverse direction in parallel to each other. The pressurizing chambers 10 included in the columns of pressurizing chambers are arranged so that their numbers gradually decrease from the long side of the actuator formed by a displacement element 50 toward the short side corresponding to the outer shape.

The nozzles 8 are arranged at substantially equal intervals of about 42 μm (interval of 25.4 mm/150=42 μm in a case of 600 dpi) in the resolution direction of the head body 13, that is, the longitudinal direction. Due to this, the head body 13 can form an image with a resolution of 600 dpi in the longitudinal direction. In the part where the trapezoid-shaped piezoelectric actuator substrates 21 overlap, the nozzles 8 located below the two piezoelectric actuator substrates 21 are arranged so as to complement each other. Due to this, the nozzles 8 are arranged in the longitudinal direction of the head body 13 at intervals corresponding to 600 dpi.

Further, at each sub-manifold 5*a*, individual channels 32 are connected at intervals corresponding to 150 dpi on an average. This means that, when designing 600 dpi worth of nozzles 8 linked divided among four sub-manifolds 5*a*, since the individual channels 32 to be linked with each sub-manifold 5*a* are not always linked at equal intervals, the individual channels 32 are formed in directions of extension of the manifold 5*a*, that is, in a main scanning direction at intervals not more than 170 μm on average (intervals of 25.4 mm/150=169 μm in a case of 150 dpi).

At positions facing the pressurizing chambers 10 in the upper surfaces of the piezoelectric actuator substrates 21, later explained individual electrodes 35 are formed. The individual electrodes 35 are one size smaller than the pressurizing chambers 10 but have substantially the same shapes as those of the pressurizing chambers 10 and are arranged so as to fit into the regions facing the pressurizing chambers 10 in the upper surfaces of the piezoelectric actuator substrates 21.

In the ejection hole surface 31*a* at the bottom of the channel member 4, a large number of ejection holes 8*d* open as openings on the lower sides of the nozzles 8. The nozzles 8 are arranged at positions avoiding the regions facing the sub-manifolds 5*a* arranged on the lower surface side of the channel member 4. Further, the nozzles 8 are arranged in the regions facing the piezoelectric actuator substrates 21 on the lower surface side of the channel member 4. An ejection hole group of the ejection holes 8 occupies a region having substantially the same size and shape as a piezoelectric actuator substrate 21. The droplets can be ejected from the ejection holes 8*d* by displacing the corresponding displacement element 50 of the piezoelectric actuator substrate 21. Further, the nozzles 8 in each ejection hole group are arranged at equal intervals along a plurality of straight lines parallel to the longitudinal direction of the channel member 4.

The channel member 4 included in the head body 13 has a multilayer structure formed by stacking a plurality of plates. These plates, from the upper surface of the channel member 4, include a cavity plate 22, base plate 23, aperture plate 24, supply plates 25 and 26, manifold plates 27, 28, and 29, cover plate 30, and nozzle plate 31. These plates are formed with large numbers of holes. The plates are stacked while positioning them so that these holes communicate with each other and form the individual channels 32 and sub-manifolds 5*a*. The head body 13, as shown in FIGS. 5A and 5B, is configured so that the portions configuring the individual channels 32 are arranged at different positions so as to be close to each other, for example the pressurizing chambers 10 are arranged at the upper surface of the channel member 4, the sub-manifolds 5*a* are arranged at the lower surface side at the inside, and the ejection holes 8*d* are arranged at the bottom surface and so that the sub-manifolds 5*a* and the ejection holes 8*d* are linked through the pressurizing chambers 10.

The holes formed in the plates will be explained. These holes include the following: First, there are the pressurizing chambers 10 formed in the cavity plate 22. Second, there are the communication holes which form channels connected from ends of the pressurizing chambers 10 to the sub-manifolds 5*a*. The communication holes are formed in each of the plates from the base plate 23 (in more detail, the entrances of the pressurizing chambers 10) up to the supply plate 25 (in more detail, the exits of the sub-manifolds 5*a*). Note that, the communication holes include the apertures 12 formed in the aperture plate 24 and the individual supply channels 6 formed in the supply plates 25 and 26.

Third, there are the communication holes which form channels connected from the other ends of the pressurizing chambers 10 to the ejection holes 8*d*. These communication holes will be called "descenders" (partial channels) in the following description. The descenders are formed in each of the plates from the base plate 23 (in more detail, the exits of the pressurizing chambers 10) up to the nozzle plate 31 (in more detail, the ejection holes 8*d*). The ejection hole 8*d* sides of the descenders are particularly small in cross-sectional areas and form the nozzles 8 at the nozzle plate 31. Details of the shapes of the nozzles 8 will be explained later.

Fourth, there are the communication holes which form the sub-manifolds 5*a*. These communication holes are formed in the manifold plates 27 to 30.

Such communication holes are linked with each other and configure the individual channels 32 from the inflowing ports of the liquid from the sub-manifolds 5*a* (the exits of the sub-manifolds 5*a*) up to the ejection holes 8*d*. The liquid supplied to the sub-manifolds 5*a* is ejected from the ejection holes 8*d* by the following route. First, the liquid runs from the sub-manifold 5*a* toward the upward direction through the individual supply channels 6 and reaches first end parts of the apertures 12. Next, it advances horizontally along the directions of extension of the apertures 12 and reaches the other end parts of the apertures 12. From there, it proceeds in the upward direction and reaches first end parts of the pressurizing chambers 10. Further, it advances horizontally along the directions of extension of the pressurizing chambers 10 and reaches the other end parts of the pressurizing chambers 10. From there, it mainly goes downward while moving in the horizontal direction little by little and advances to the ejection holes 8*d* opened in the bottom surface.

Each piezoelectric actuator substrate 21, as shown in FIGS. 5A and 5B, has a multilayer structure comprised of two piezoelectric ceramic layers 21*a* and 21*b*. Each of these piezoelectric ceramic layers 21*a* and 21*b* has a thickness of about 20 μm. The thickness of the part of the piezoelectric actuator substrate 21 displacing, that is, the displacement element 50, is about 40 μm. By being not more than 100 μm, the amount of displacement can be made large. Both of the piezoelectric ceramic layers 21*a* and 21*b* extend across a plurality of pressurizing chambers 10 (see FIG. 3). These piezoelectric ceramic layers 21*a* and 21*b* are made of a lead zirconate titanate (PZT)-based ceramic material having ferroelectricity.

Each piezoelectric actuator substrate 21 has a common electrode 34 made of Ag—Pd or another metal material and individual electrodes 35 made of Au or another metal material. The individual electrodes 35 are arranged on the upper surface of the piezoelectric actuator substrate 21 at positions facing the pressurizing chambers 10 as explained above. One end of each individual electrode 35 is configured by an individual electrode body 35*a* facing a pressurizing chamber 10 and an lead out electrode 35*b* which is led out to the outside of the region facing the pressurizing chamber 10.

The piezoelectric ceramic layers 21*a* and 21*b* and common electrode 34 have substantially the same shapes. Therefore, if preparing these by simultaneous firing, the warping can be kept small. A piezoelectric actuator substrate 21 of 100 μm or less easily warps in the firing process. The amount becomes large as well. Further, if warping occurs, when stacking the substrate on the channel member 4, the parts are joined by causing that warped part to deform, therefore the deformation at that time influents fluctuation of the characteristics of the displacement element 50 and consequently leads to variation of the liquid ejection characteristics. Therefore, the warping is desirably a small one of at most the same extent as the thickness of the piezoelectric actuator substrate 21. Further, in order to reduce warping due to a difference of behavior in shrinking during firing between a location where there is an internal electrode and a location where there isn't, the internal electrode of the common electrode 34 is formed flat without projecting patterns at the inside. Note that, here, "the substantially the same shapes" means that the difference in the dimensions at the peripheries is not more than 1% of the widths of those portions. The peripheries of the piezoelectric ceramic layers 21*a* and 21*b* are basically formed by cutting the layers before firing in a state where they are superimposed on each other, therefore their positions become the same within a range of processing accuracy. The common electrode 34 is also resistant against warping if formed by cutting it at the same time as the piezoelectric ceramic layers 21*a* and 21*b* after solid printing. However, by printing it by patterns with similar shapes to the piezoelectric ceramic layers 21*a* and 21*b* but a bit smaller, the common electrode 34 is no longer exposed at the side surfaces of the piezoelectric actuator 21, therefore the electrical reliability becomes higher.

Details will be explained later, but the individual electrodes 35 are supplied with driving signals (drive voltages) from the control part 88 through an FPC (flexible printed circuit) as external wiring. The driving signals are supplied by a constant period synchronous with the conveying speed of the printing paper P. The common electrode 34 is formed over substantially the entire surface in the surface direction in the region between the piezoelectric ceramic layer 21*a* and the piezoelectric ceramic layer 21*b*. That is, the common electrode 34 extends so as to cover all pressurizing chambers 10 in the regions facing the piezoelectric actuator substrates 21. The thickness of the common electrode 34 is about 2 μm. The common electrode 34 is grounded in a not shown region and is held at the ground potential. In the present embodiment, a surface electrode (not shown) different from the individual electrodes 35 is formed on the piezoelectric ceramic layer 21*b* at a position avoiding the group of electrodes configured by the individual electrodes 35. The surface electrode is electrically connected to the common electrode 34 through a through-hole formed inside the piezoelectric ceramic layer 21*b* and is connected to external wiring in the same way as the large number of individual electrodes 35.

Note that, as will be explained later, predetermined driving signals are selectively supplied to the individual electrodes 35. Due to this, pressure is applied to the liquid in the pressurizing chambers 10 corresponding to the individual electrodes 35. Due to this, through the individual channels 32, droplets are ejected from the corresponding ejection holes 8. That is, the portions facing the pressurizing chambers 10 in the piezoelectric actuator substrates 21 correspond to the individual displacement elements 50 (actuators) corresponding to the pressurizing chambers 10 and ejection holes 8. That is, in the stacked body configured by the two piezoelectric ceramic layers, a displacement element 50 having the structure as shown in FIG. 5 as a unit structure is assembled for each pressurizing chamber 10 by portions of vibration plate 21*a*, common electrode 34, piezoelectric ceramic layer 21*b*, and individual electrodes 35 right above the pressurizing chamber 10. The piezoelectric actuator substrates 21 include pluralities of displacement elements 50. Note that, in the present embodiment, the amount of the liquid which is ejected from an ejection hole 8 by one ejection operation is about 5 to 7 μL (picoliters).

When viewing a piezoelectric actuator substrate 21 on a plane, the individual electrode bodies 35*a* are arranged so as to be superimposed on the pressurizing chambers 10. The part of the piezoelectric ceramic layer 21*b* positioned at the center of a pressurizing chamber 10 and sandwiched between an individual electrode 35 and the common electrode 34 is polarized in the stacking direction of the piezoelectric actuator substrate 21. The orientation of polarization may be upward or downward. By giving a driving signal corresponding to that direction, driving can be carried out.

As shown in FIG. 5, the common electrode 34 and the individual electrodes 35 are arranged so as to sandwich only the piezoelectric ceramic layer 21*b* at the uppermost layer. A region in the piezoelectric ceramic layer 21*b* which is sandwiched between an individual electrode 35 and the common electrode 34 is called an "active portion". Polarization is applied in the thickness direction to the piezoelectric ceramic in that portion. In a piezoelectric actuator substrate 21 in the present embodiment, only the piezoelectric ceramic layer 21*b* at the uppermost layer includes active portions. The piezoelectric ceramic 21*a* does not include active portions and acts as a vibration plate. This piezoelectric actuator substrate 21 has a so-called unimorph type configuration.

In an actual driving procedure in the present embodiment, the individual electrodes 35 are rendered a potential higher than the common electrode 34 (below, referred to as a "high potential") in advance. Whenever there is an ejection request, the individual electrodes 35 are once rendered the same potential as that of the common electrode 34 (below, referred to as a "low potential"), then are again rendered the high potential at a predetermined timing. Due to this, at the timing when the individual electrodes 35 become the low potential, the piezoelectric ceramic layers 21*a* and 21*b* return to their original shapes, therefore the capacities of the pressurizing chambers 10 increase compared with the initial state (state where the potentials of the electrodes are different). At this time, negative pressures are given to the interiors of the pressurizing chambers 10, and liquid is sucked into the pressurizing chambers 10 from the manifold 5 sides. After that, at the timing when the individual electrodes 35 are rendered the high potential again, the piezoelectric ceramic layers 21*a* and 21*b* deform so as to protrude to the pressurizing chamber 10 sides, and the capacities of the pressurizing chambers 10 are reduced. By this, the pressures in the pressurizing chambers 10 become positive pressures, the pressures to the liquid rise, and droplets are ejected. That is, in order to eject droplets, driving signals including pulses based on the high potential are supplied to the individual electrodes 35. This pulse width is ideally the AL (acoustic length) duration of propagation of a pressure wave from the manifolds 5 to the ejection holes 8*d* in the pressurizing chambers 10. According to this, when the internal portions of the pressurizing chambers 10 invert from the negative pressure state to the positive pressure state, pressures of the two are combined, and the droplets can be ejected under a stronger pressure.

As explained above, each nozzle 8 is a through hole formed in the nozzle plate 31. Further, the nozzles 8 are arranged in the same regions as the four trapezoidal-shaped pressurizing chamber groups 9 shown in FIG. 2. The nozzles 8 in the head body 13 are arranged in the nozzle arrangement region 7 formed by combining trapezoidal shapes (see FIG. 6A). The nozzle arrangement region 7 has unevenness due to the combination of trapezoids but is roughly a rectangular region which is long in the longitudinal direction of the head body 13 as a whole.

A "center part 7*a*" of the nozzle arrangement region 7 means a region which is positioned at the center and has a length of ⅕ of the whole when equally dividing the nozzle arrangement region 7 into five sections in the longitudinal direction. Further, the "end parts 7*b*" of the nozzle arrangement region 7 mean the two regions positioned on the ends each having a length of ⅕ of the whole when equally dividing the nozzle arrangement region 7 into five sections in the longitudinal direction. The end part 7*b* positioned on the left side will be sometimes referred to as the "first end part 7*ba*", while the end part positioned on the right side will be sometimes referred to as the "second end part 7*bb*". Note that, in this embodiment, the center part 7*a* and end parts 7*b* in the longitudinal direction of the nozzle arrangement region 7 are explained, but the center part and end parts in another direction may be rendered the state similar to this explanation as well.

The thickness of the nozzle plate 31, that is, the length of each nozzle 8, is for example 20 to 100 μm. In order to make the fluid resistance of the nozzle 8 low, the thickness of the nozzle plate 31 is desirably as thin as possible. However, if it is too thin, handling in manufacturing becomes difficult. Therefore, the thickness is set at the optimum value as a thickness where both can be achieved. The shape of the cross-section of the nozzle 8 is preferably circular, however, it may also be elliptical, triangular, square, or another rotary symmetrical shape. The shape of the portion in the nozzle 8 which has the smallest cross-sectional area is for example a circle having a diameter of 10 to 60 μm. The diameter of the portion having the smallest cross-sectional area is the control factor for setting the ejection amount and is set in accordance with the desired ejection amount.

One opening of each nozzle 8 is an ejection hole 8*d* which opens to the outside of the channel member 4 and is an opening at the side where the liquid is ejected. Further, the other opening of the nozzle 8 is an internal opening 8*c* which opens toward the inside of the channel member 4 and is an opening at the side where the liquid is supplied.

This means the following when viewing the nozzle plate 31 alone. One surface of the nozzle plate 31 forms a first surface 31*a* which forms a surface on the side from which the liquid flies out, that is, the ejection hole surface 31*a*, while the surface on the opposite side to the first surface 31*a* forms a second surface 31*b*. The through holes which form the nozzle 8 penetrate from the first surface 31*a* to the second surface 31*b*. The openings of the through holes in the first surface (ejection hole surface) 31*a* side form the ejection holes 8*d*, while the openings of the through holes in the second surface 31*b* side form the internal openings 8*c*.

Each nozzle 8, on the ejection hole 8*d* side, includes the inversely tapered part 8*b* in which the cross-sectional area of the opening becomes larger toward the ejection hole 8*d*. The inversely tapered part 8*b*, when viewed from the ejection hole 8*d* side, that is, from the ejection hole surface 31*a* side, looks like a ring-shaped region on the periphery of a circular portion penetrating through the nozzle plate 31. The width of this ring-shaped region in the case where it is viewed from the ejection hole 8*d* side will be defined as the width T of the inversely tapered part 8*b* (this will be sometimes simply be referred to as the "width T"). The width T will be explained by using FIG. 6B. FIG. 6B is a plan view when viewing the nozzle 8 from the ejection hole 8*d* side. The inversely tapered part 8*b* appears like it is ring shaped. L1 is a virtual straight line along the longitudinal direction of the liquid ejection head 2. The widths of the facing portions in the inversely tapered part 8*b* along L1 are T1*a* [μm] and T1*b* [μm]. L2 is the direction in which the liquid ejection head 2 and the recording medium are relatively conveyed at the time of printing. The widths of the facing portions along L2 in the inversely tapered part 8*b* are T2*a* [μm] and T2*b* [μm].

The width T will be explained another way using FIG. 5B. The nearest point A is the narrowest part of the nozzle 8. The length from the outside of the diameter D at the nearest point A up to the edge of the opening of the ejection hole 8*d*, that is, the boundary between the nozzle 8 and the ejection hole surface 31*a*, along the ejection hole surface 31*a*, is the width T. In FIG. 5B, the widths T at two facing locations are shown as T2*a* [μm] and T2*b* [μm].

The width T of the inversely tapered part 8*b* in one nozzle 8 is the average of the widths T of different parts of the inversely tapered part 8*b* in that nozzle 8 and can be measured by for example calculating a mean value of T1*a*, T1*b*, T2*a*, and T2*b*. In one nozzle 8, if the variation of the widths of the inversely tapered part 8*b* due to the location is small, one portion may be measured and that value may be defined as the width T of that nozzle 8. Further, the surface area of the inversely tapered part 8*b* when viewed from the ejection hole 8*d* side may be divided by the length of the outer circumference of the ejection hole 8*b* to calculate the width T of the nozzle 8 as well.

If the width T becomes large, the liquid builds up from the ejection hole surface 31*a*, therefore when the liquid flies off from the ejection hole surface 31*a*, the force pulling the liquid back into the nozzle 8 becomes large. That is, if the width T becomes large, the speed of flight of the liquid falls. Further, if the width T becomes large, part of the liquid does not fly off, but is pulled back into the nozzle 8, therefore the amount of the ejected liquid becomes small. These actions may be due to the surface tension of the liquid.

Further, when the length of a nozzle 8 becomes longer, the fluid resistance of the nozzle 8 becomes larger, therefore the speed of flight of the liquid falls. The length of a nozzle 8 is the thickness of the nozzle plate 31, therefore the speed of flight of the liquid which is ejected from a nozzle 8 located in a thick portion of the nozzle plate 31 becomes lower.

The width T and the thickness of the nozzle plate 31 are desirably constant in the nozzle plate 31. However, as will be explained later, due to conditions in the manufacturing processes, they are sometimes tend to vary with certain distributions in the nozzle plate 31. Therefore, it may be considered to reduce the variation of speed of flight by controlling the distributions in the nozzle plate 31 to cancel out their influences with each other.

The first surface of the nozzle plate 31 comprised of the ejection hole surface 31*a* is provided with a first region and a second region which is not superimposed on the first region. In the embodiment explained above, for example, the center part 7*a* can be provided as the first region, and the end parts 7*b* can be provided as second regions. Conversely, the center part 7*a* can be provided as the second region, and the end parts 7*b* can be provided as first regions. Further, a region which is different from the center part 7*a* and end parts 7*b* can be provided as the first region or second region as well.

A nozzle (through hole) 8 arranged in the first region will be defined as a "first nozzle" (first through hole), and a nozzle (through hole) 8 arranged in the second region will be defined as a "second nozzle" (second through hole). The width T of the first nozzle is made larger than the width T of the second nozzle, and the thickness of the nozzle plate 31 in the first region becomes thinner than the thickness of the nozzle plate 31 in the second region. By doing this, the influence by the width T and the influence by the thickness of the nozzle plate 31 are cancelled out, therefore it is possible to reduce the difference between the speed of flight of the droplets ejected from the first nozzle in the first region and the speed of flight of the droplets ejected from the second nozzle in the second region.

The number of nozzles 8 included in each region only has to be one or more. There are no restrictions on the breadth and arrangement of each region. It is unnecessary that the widths T of all nozzles 8 in the first region are larger than the widths T of all nozzles 8 in the second region. The average of the widths T of the nozzles 8 in the first region only has to be larger than the average width T of the nozzles 8 in the second region. The average in each region may be obtained by measuring all nozzles 8 and calculating the average of the results if there are five or less. If there are more than five, the average may be obtained by measuring the nozzle 8 near the center of the region and, based on that center, the four nozzles 8 which are most distant from that center in the four directions each different by 90 degrees and calculating the average of the results. Note that, in a case where four nozzles 8 corresponding to such conditions do not exist, and only three or two exist, the corresponding three or two may be calculated. The thickness of the nozzle plate 31 may be measured so as to include the nozzles 8 measured in its width T.

Even if the difference of speed of flight is reduced by cancellation, the ranges of changes of the width T and the thickness of the nozzle plate 31 are desirably small in the nozzle plate 31. There is a case where the width T and the thickness of the nozzle plate 31 change by certain trends in the nozzle plate 31 related to the manufacturing conditions. In such case, those tendencies are controlled and the ranges of changes are made small. Specifically, in a predetermined direction of the nozzle plate 31, a second region, first region, and second region are arranged in that order or a first region, second region, and first region are arranged in that order. When a second region, first region, and second region are arranged in that order, concerning the width T, a region having a narrow width T, a region having a broad width T, and a region having a narrow width T are arranged. Concerning the thickness, a thin region, a thick region, and a thin region are arranged. By setting the manufacturing conditions so that such trends are caused, the ranges of changes in the width T and the thickness of the nozzle plate 31 can be made smaller.

The changes of the width T and the thickness of the nozzle plate 31 become large in the direction where the spread of the nozzle arrangement region 7 is large. That is, when the nozzle arrangement region 7 is long in one direction, the changes become large in the longitudinal direction. Therefore, desirably a second region, first region, and second region are arranged in that order in the longitudinal direction or a first region, second region, and first region are arranged in that order. Further, in order to make the difference of speed of flight in the entire area of the nozzle plate 31 small, preferably the center part 7*a* of the nozzle plate 31 is set to become the first region and the end parts 7*b* on the two ends to become the second regions or the center part 7*a* is set to become the second region and the end parts 7*b* on the two ends are set to become the first regions.

Next, the case where the center part 7*a* of the nozzle plate 31 is the first region and the end parts on the two ends are the second regions will be further explained. Also in an inverse case, the relationships between the width T and the thickness of the nozzle plate 31 and the speed of flight become the same as that in the following explanation.

The center part 7*a* of the nozzle plate 31 being the first region and the end parts 7*b* on the two ends being second regions means that the width T is broad in the center part 7*a* and is narrow at the end parts 7*b* on the two ends. In the method of production of the nozzle plate 31 which will be explained later, the width T sometimes exhibits such a trend. Therefore, by making the thickness of the nozzle plate 31 thin at the center part 7*a*, but thick at the two end parts, the influence due to the tendency of the width T can be cancelled out.

For example, assume that, at the second regions of the end parts on the two sides of the nozzle plate 31, the thickness of the nozzle plate 31 is 40 μm, the width T is 1 μm, and the speed of flight is 7 m/s. At the first region of the center part 7*a* of the nozzle plate 31, if the width T is 2.6 μm, the speed of flight falls by about 0.7 m/s due to the influence of that. Further, if the thickness of the center part 7*a* of the nozzle plate 31 is made 35 μm, the speed of flight rises by about 0.7 m/s due to the influence of that. Accordingly, those influences are cancelled out by each other, so the speed of flight at the center part 7*a* can be controlled to about 7 m/s.

In order to reduce the variation in the speed of flight, desirably a difference between the width T at the first end part 7*ba*, defined as the width TE1, and the width T at the second end part 7*bb*, defined as the width TE2, is small. The degree of influence upon the speed of flight is considered to be not the value of difference itself, but the ratio of difference relative to TE1 and TE2. Therefore, when evaluating (absolute value in difference between TE1 and TE2)/(mean value of TE1 and TE2), that value is preferably ⅕ or less, further preferably 1/10, particularly preferably 1/20. Note that, the width TE1 of the first end part 7*ba* and the width TE2 of the second end part 7*bb* may be measured in the same way as the widths T of the first region and the second region.

In the case explained above, if the average of the end parts on the two sides is 1 μm, while the width TE1 of the first end part 7*ba* is 0.6 μm and the width TE2 of the second end part 7*bb* is 1.4 μm, (TE2−TE1)/[(TE1+TE2)/2] becomes equal to 0.2, that is, ⅕. That is, the difference between the width TE1 and the width TE2 is preferably made this or lower.

In order to make the variation of speed of flight small, desirably the difference between a thickness DE1 of the nozzle plate 31 at the first end part 7*ba* and a thickness DE2 at the second end part 7*bb* is small. The degree of influence upon the speed of flight is considered to be not the value of the difference itself, but the ratio of difference relative to DE1 and DE2. Therefore, when evaluating (absolute value in difference between DE1 and DE2)/(mean value of DE1 and DE2), that value is preferably 1/20 or less, further preferably 1/40, and particularly preferably 1/80. Here, the reason why this numerical value has become smaller than the numerical value for the width T is that the thickness of the nozzle plate 31 exerts a larger influence upon the speed of flight than the width T. Note that, the thickness DE1 of the first end part 7*ba* and the thickness DE2 of the second end part 7*bb* may be measured in the same way as the thicknesses in the first region and second region.

In the case explained above, if the average of the two end parts was 40 μm, while the thickness DE1 of the first end part 7*ba* is 43.5 μm, and the thickness DE2 of the second end part 7*bb* is 36.5 μm, (DE2−DE1)/[(DE1+DE2)/2] becomes equal to about 0.043. That is, the difference between the thickness DE1 and the thickness DE2 is preferably made this extent or lower.

Preferably the influence due to the width T and the influence due to the thickness of the nozzle plate 31 are cancelled out also between the first end part 7*ba* and the second end part 7*bb*. That is, when the width TE2 of the second end part 7*bb* is larger than the width TE1 of the first end part 7*ba*, the thickness DE1 of the nozzle plate 31 at the first end part 7*ba* is preferably thinner than the thickness DE2 of the nozzle plate 31 at the second end part 7*bb*. Conversely, when the width TE2 of the second end part 7*bb* is smaller than the width TE1 of the first end part 7*ba*, the thickness DE1 of the nozzle plate 31 at the first end part 7*ba* is preferably thicker than the thickness DE2 of the nozzle plate 31 at the second end part 7*bb*.

The width T of an inversely tapered part 8*b* is preferably 4 μm or less. The length of the inversely tapered part 8*b*, i.e., by another expression, the depth of the inversely tapered part 8*b*, is preferably 10 μm or less, more preferably 5 μm or less. The longer the length of the inversely tapered part 8*b*, the easier the variation in the meniscus position at the time of ejection and the easier the variation in the ejection direction. Therefore, the length of the inversely tapered part 8*b* is preferably short.

Each nozzle 8 includes at the internal opening 8*c* side the tapered part 8*a* in which the cross-sectional area of the opening becomes larger toward the internal opening 8*c*. The internal opening 8*c* of the tapered part 8*a* is inclined by an angle θ relative to the direction perpendicular to the nozzle plate 31. θ is preferably 10 to 30 degrees. The inclination of the tapered part 8*a* is substantially constant over at least a half of the length of the tapered part 8*a* on the internal opening 8*c* side. The inclination gradually becomes gentler the further to the ejection hole 8*d* side from the portion having substantially a constant inclination resulting in linkage with the inversely tapered part 8*b* at the portion having the smallest cross-sectional area. The boundary between the tapered part 8*a* and the inversely tapered part 8*b* does not include any edge where the angle suddenly changes. The angle smoothly changes from the tapered part 8*a* to the inversely tapered part 8*b*.

Here, consider the shape of the inner surface of a nozzle 8 positioned in a certain direction distant from the center axis of the nozzle 8. At the internal opening 8*c* side, the distance from the center axis is long. The distance from the center becomes shorter from the internal opening 8*c* toward the ejection hole 8*d*. The distance becomes the shortest at a certain location. This location is the boundary between the tapered part 8*a* and the inversely tapered part 8*b* and is called the "nearest point A". The nozzle 8 ideally has the shape of a rotating body with respect to the center axis. Preferably the depth of the nearest point A, that is, the distance from the ejection hole 8*a*, does not change for each angle seen from the center axis. In actuality, however, a certain extent of variation occurs on manufacture. If the nearest point A is the edge part where the angle drastically changes and there is a large variation in the position in the depth direction of the nearest point A among each angle from the center axis, the variation in the ejection direction also becomes large. For this reason, preferably there is no edge part and the angle smoothly changes from the tapered part 8*a* to the inversely tapered part 8*b*.

Further, the surface roughness of the inner surface of a nozzle 8 is smaller in the inversely tapered part 8*b* than the tapered part 8*a*. Due to this, it is possible to suppress variation in the ejection direction due to the influence of unevenness at the inversely tapered part 8*b* side. This is believed to be because if the surface roughness of the inversely tapered part 8*b* is large, separation of the tail from the inversely tapered part 8*b* becomes delayed and therefore the influence of the difference of the width of the inversely tapered part 8*b* becomes larger or the position at which the tail finally separates varies due to the influence of the surface roughness, but due to the above, such effects become harder to occur. The surface roughness of the inner surface of the nozzle 8 can be measured by cutting the nozzle 8 in the vertical direction. The surface roughness of the tapered part 8*a* is controlled to for example Rmax0.13 to 0.25 μm, while the surface roughness of the inversely tapered part 8*b* is controlled to for example Rmax0.10 to 0.15 μm. If the surface roughness of the inversely tapered part 8*b* is smaller by 0.02 μm or more than the surface roughness of the tapered part 8*a*, it is possible to suppress the variation of ejection direction more, so this is preferable.

Next, two methods of production for manufacturing a nozzle plate 31 provided with such nozzles 8 will be explained. First, a method of production using a negative type photoresist on which exposed portions are cured will be explained, then a method of production using a positive type photoresist from which exposed portions are dissolved will be explained.

Figure 7A:
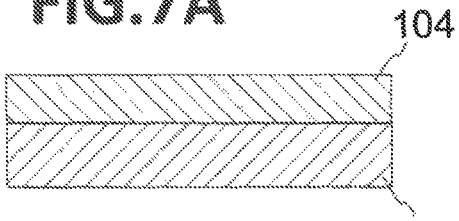
FIGS. 7A to 7E are schematic cross-sectional views of steps in one method of production for manufacturing a nozzle plate according to an embodiment of the present disclosure.

FIGS. 7A to 7E are vertical cross-sectional views of steps of the method of production of a nozzle plate 31 using a negative type photoresist. First, an electroforming substrate 102 made of stainless steel or another metal is prepared. In the electroforming substrate 102, the surface on the side where the nozzle plate 31 is to be formed by plating in a later explained step is preferably polished to Rmax100 nm or less. As shown in FIG. 7A, a negative type photoresist film 104 is formed on the side of the polished surface of the electroforming substrate 102. The photoresist film 104 is formed by coating a liquid photoresist by spin coating or another technique or by hot press bonding a dry film type resist.

Figure 7B:
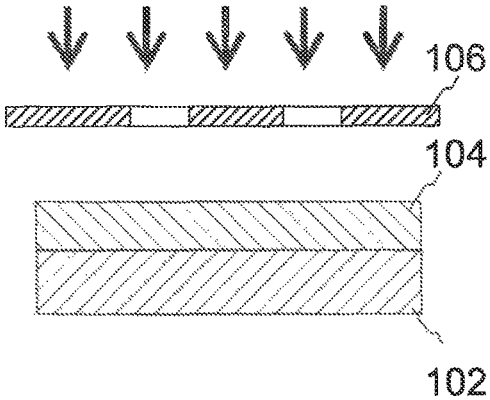

A photo mask 106 formed with a mask pattern so that nozzles 8 can be formed with desired dimensions and arrangement is prepared. As shown in FIG. 7B, the photoresist film 104 is exposed through the photo mask 106. As the light source, use may be made of g-rays of a high pressure mercury lamp (wavelength: 436 nm), i-rays of a high pressure mercury lamp (wavelength: 365 nm), a KrF excimer laser (wavelength: 248 nm), ArF excimer laser (wavelength: 193 nm), or the like.

The photomask 106 allows light to pass through only the portions corresponding to the nozzles 8. The parts of the photoresist film 104 under the opening portions are cured since the light strikes it (below, the parts which are cured will be sometimes referred to as the "cured parts"). The light passing through the photomask 106 spreads outward from the opening portions due to the phenomenon of light diffraction. In the vicinities of the boundaries of the opening portions, the light becomes weaker by the amount of the diffraction light which spreads outward, therefore the amount of sensitization of the photoresist film 104 falls. Basically, the larger the distance from the photomask 106, the greater the influence by this. That is, the further from the photomask 106, gradually the narrower the range of the cured parts. Due to this, the cured parts become shapes forming the tapered parts 8*a*.

However, the photoresist film 104 at the portion immediately above the electroforming substrate 102 is also exposed by the light which is reflected at the interface between the electroforming substrate 102 and the photoresist film 104. For this reason, in the vicinity of this interface, the dimensions of the cured parts become larger. The reflected light is diffused and attenuates inside the photoresist film 104. Therefore, the further from the interface, gradually the smaller the sizes of the cured parts.

The effect of reflected light occurs in the range from the interface between the electroforming substrate 102 and the photoresist film 104 to about 1 to 10 μm. By doing this, the cured parts become shapes forming the inversely tapered parts 8*b* in the vicinity of the interface. At a place which is further distant from the interface, the influence of the reflection light becomes smaller and the influence of the diffraction light explained above becomes larger, therefore the cured parts become shapes forming tapered parts 8*a* which become larger the further from the interface. Further, by doing this, it is possible to form cured parts which become shapes gradually changing in angle from the inversely tapered parts 8*b* to the tapered parts 8*a*. In the method of production of the positive type, the angles from the inversely tapered parts 8*b* to the tapered parts 8*a* change more smoothly and gradually to link the parts, therefore preparation of a nozzle plate 31 by a positive type photoresist film 104 is more preferred than that by a negative type.

Here, since the surface on the side where the photoresist film 104 is to be formed is polished as explained above, the light reflected at the electroforming substrate 102 is substantially uniformly reflected at the side corresponding to the ejection holes 8*d* of the nozzles 8. Due to this, variation in the shapes of the cured parts of the photoresist film 104 corresponding to the inversely tapered parts 8*b* of the nozzles 8 according to position becomes smaller. If the polishing is insufficient and therefore there is unevenness or there are parts having a low reflectivity, the difference of intensity of the reflected light becomes large depending to the positions in the nozzle 8. If there are parts having weak reflection light, curing does not advance at those parts, therefore the inversely tapered parts 8*b* become smaller and also the widths of the inversely tapered parts 8*a* become smaller. Conversely, if there are parts having strong reflection light, curing advances at those parts, therefore the inversely tapered parts 8*a* become larger and also the widths of the inversely tapered parts 8*a* become larger. If there are such parts, the difference in the width of the inversely tapered part 8*a* between the parts of the inner surface of the nozzle facing each other becomes larger. If that difference becomes 1.5 μm or more, a drop in precision occurs in the ejection direction.

Figure 7C:
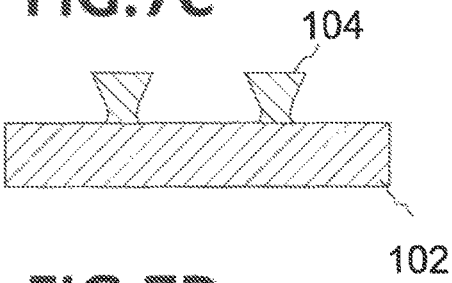

Next, the uncured photoresist film 104 is removed by a development solution. Due to this, the cured parts of the photoresist film 104 which form the shapes of the nozzles 8 are left by patterning as shown in FIG. 7C.

In the above explanation, the explanation was given as if the cured parts and the uncured parts were clearly different. In actuality, however, the state between the cured parts and the uncured parts continuously varies. If development is strongly carried out on a part having a low degree of curing, the photoresist film 104 does not remain, but the photoresist film 104 remains if weak development is carried out. That is, even if the degrees of curing due to exposure are the same, according to whether the development is strong or weak, a difference arises in the shapes of the cured parts which remain. The parts of the photoresist film 104 which correspond to the inversely tapered parts 8*b* as explained above are not parts which are directly cured, therefore are easily influenced by development.

The development is for example carried out as follows. The electroforming substrate 102 is made to rotate at 100 rpm while the development solution is supplied. Further, the photoresist film 104 is held for 50 seconds in a state immersed in the development solution for still development, then the development solution is discharged. Such a process is repeated several times. The region corresponding to the nozzle plate 31 is a rectangular region which is long in one direction. At the time of making the electroforming substrate 102 rotate while the development solution is being supplied, a difference arises in the speed of flow of the development solution in the long rectangular region. If the speed of flow of the development solution is fast, the development becomes strong, so it becomes harder to make the photoresist film 104 remain. As a result, the inversely tapered parts 8*b* become smaller.

Generally speaking, in the rectangular region corresponding to the nozzle plate 31, desirably the difference of intensity of development is small. However, as explained above, in this case, a desired difference is given to the shapes of the inversely tapered parts 8*b* so that the influence of the thickness of the nozzle plate 31 is cancelled out. Note that, conversely, the difference of the intensity of the development which remains even if the conditions are adjusted may also be cancelled out by adjusting the thickness of the nozzle plate 31. The adjustment of development is for example carried out as follows.

In order to reduce the difference of development between the end parts 7*b* on the two sides in the rectangular region corresponding to the nozzle plate 31, the rectangular region may be arranged at a position which is symmetrical with respect to rotation. Due to this, the intensity of development becomes substantially symmetrical in the longitudinal direction in the rectangular region corresponding to the nozzle plate 31. More specifically, the rectangular region corresponding to the nozzle plate 31 is arranged so that the virtual straight line passing through the center of rotation and the virtual straight line along the longitudinal direction of the rectangular region corresponding to the nozzle plate 31 are substantially perpendicular to each other in the vicinity of the center of the rectangular region corresponding to the nozzle plate 31. When arranged in this way, between the first end part 7*ba* and the second end part 7*bb*, the speeds of flow of the development solutions when supplying the development solutions can be made substantially the same, therefore the intensities in development can also be made substantially the same. Note that, in the above case, at the center part 7*a*, compared with the first end part 7*ba* and the second end part 7*bb*, the speed of the development solution becomes slow, therefore the development becomes weak, and the inversely tapered part 8*b* is apt to become large.

In order to make the difference in the intensity of development between the end parts 7*b* on the two sides and the center part 7*a* small, the influence of the rotation may be made relatively small. For example, by making the rotation speed slower or making the time of the still development longer, the influence of the development at the time of rotation may be made relatively small. Conversely, in order to make the difference in the intensity of development between the end parts 7*b* on the two sides and the center part 7*a* larger, the rotation speed may be made faster or the time of the still development may be made shorter.

Note that, in order to make the inversely tapered part 8*b* in the center part 7*a* smaller, after performing the development as explained above, the region corresponding to the nozzle plate 31 may be divided and additional development may be performed only for the center part 7*a*.

As explained above, even if the arrangement of the rectangular region corresponding to the nozzle plate 31 is made symmetric, there sometimes arises a very small difference in the intensity of development between the first end part 7*ba* and the second end part 7*bb*. This is considered to be due to the influence by the rotation direction, position of supply of the development solution, the amount of supply of the development solution, etc. When this influence is large, adjustment is carried out as follows to make the difference between the width TE1 and the width TE2 small.

When processing under the same conditions, the trends in intensity of development become almost the same, therefore adjustment is carried out so that those trends are cancelled out. For example, if the development becomes stronger in the first end part 7*ba* than that in the second end part 7*bb*, the arrangement of the rectangular region corresponding to the nozzle plate 31 may be offset a little from the position where it is symmetrical about rotation to thereby control the distance from the center of the rotation up to the second end part 7*bb* to become a bit longer than the distance from the center of the rotation to the first end part 7*ba*. When doing this, the speed of the development solution passing through the second end part 7*bb* becomes faster, therefore the intensity of development can be strengthened.

After development in the development solution, according to need, a rinse is carried out by superpure water or the like so as to prevent unwanted parts from remaining.

Figure 7D:
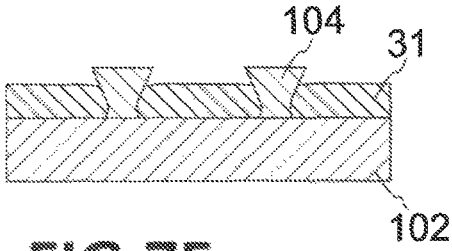

The nozzle plate 31 is prepared by forming a plating film 31 on the electroforming substrate 102 on which the patterned photoresist film 104 was formed prepared as described above. The electroforming substrate 102 is dipped in a plating solution containing Ni, Cu, Cr, Ag, W, Pt, Pd, Rd, or the like and supplying electricity whereby, as shown in FIG. 7D, the plating film 31 is formed on the surface of the electroforming substrate 102 on which the photoresist film 104 was arranged. The plating film 31 for example contains Ni as its principal ingredient. The formation of the plating film 31 is stopped by time management or the like before it reaches the height of the photoresist film 104 resulting in the nozzle plate 31 of a predetermined thickness.

At the time of formation of the plating film 31, it is possible to arrange a shield plate restricting the movement of ions so as to adjust the distribution of thickness of the plating film 31. The plating solution is placed in a plating tank which is larger than the plating film 31 which forms the nozzle plate 31. That is, the route of flow of ions becomes broader than the region in which the plating film 31 is formed. Under such conditions, compared with the center part 7*a* of the plating film 31, the outer circumferential portion of the plating film 31 becomes faster in growth. As a result, in the outer circumferential portion of the nozzle plate 31, the thickness becomes greater compared with the center part 7*a*. By suitably arranging the shield plate, this tendency can be weakened. Conversely, when increasing the number of shield plates arranged at the outer circumferential portion of the plating film 31 and narrowing the route of flow of ions compared with the center part 7*a*, the thickness of the outer circumferential portion of the nozzle plate 31 can be made smaller compared with the center part 7*a*. Even if the shield plate is arranged symmetrical relative to the nozzle plate 31, the thickness of the nozzle plate 31 sometimes becomes asymmetrical. This is considered to be derived from the influences by the position of the nozzle plate 31 in the plating tank and so on. Where the difference in the thickness between the first end part 7*ba* and the second end part 7*bb* is large, by arranging the shield plate considering that difference, the difference in thickness between the first end part 7*ba* and the second end part 7*bb* can be made small.

Next, the photoresist film 104 inside the nozzles 8 is removed by using an organic solvent or the like. Further, the nozzle plate 31 is peeled off from the electroforming substrate 102.

Figure 7E:
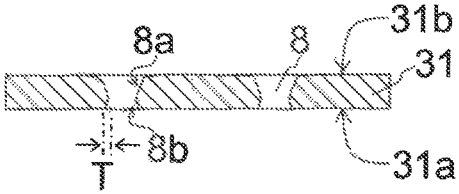

In the peeled off nozzle plate 31, as shown in FIG. 7E, nozzles 8 having tapered parts 8*a* on the upper side in the drawing and inversely tapered parts 8*b* on the lower side in the drawing are formed. According to need, the surface on the ejection hole 8*d* side of the nozzle plate 31 may be formed with a water repellent (ink repellent) film or the like by a fluororesin, carbon, or the like.

Note that, before performing exposure, heating may be carried out in advance to promote the curing reaction. The heating step can be easily controlled if using an oven, hotplate, etc. Further, due to this heating step, in the photoresist film 104, the curing reaction on the electroforming substrate 102 side is promoted more, therefore the surface roughness of the side surfaces of the photoresist film 104 after development becomes smaller on the side close to the electroforming substrate 102 than the side far from the electroforming substrate 102. The surface roughness of the side surfaces of the photoresist film 104 after the development is transferred to the nozzles 8 and becomes the surface roughness of the inner surfaces of the nozzles 8. For this reason, if prepared as described above, the surface roughness of the inversely tapered parts 8*b* can be made smaller than the surface roughness of the tapered parts 8*a*. The surface roughness of the inversely tapered parts 8*b*, which exert a great influence upon the ejection characteristics, becomes smaller, so the variation in the ejection characteristics can be reduced.

FIGS. 7F to 7J are vertical cross-sectional views of steps of the method of production of a nozzle plate 31 using a positive type photoresist.

Figure 7F:
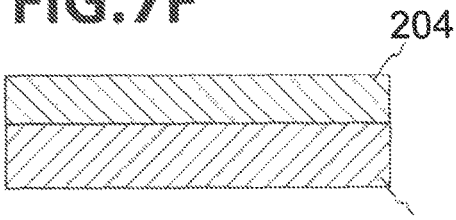
FIGS. 7F to 7J are schematic cross-sectional views of steps in another method of production for manufacturing a nozzle plate according to an embodiment of the present disclosure.

In FIG. 7F, a positive type photoresist film 204 is formed on one surface of an electroforming substrate 202. As the electroforming substrate 202, one substantially the same as the one used in the negative type explained above may be used. However, the surface on the photoresist film 204 side does not always have to be polished. This is because in this manufacturing process, the interface side between the electroforming substrate 202 and the photoresist film 204 becomes the internal opening 8*c* sides of the nozzles 8. Therefore, even if the precision of formation on the internal opening 8*c* sides varies due to the influence of the light reflected at the interface between the electroforming substrate 202 and the photoresist film 204, the influence exerted upon the ejection characteristics is lower compared with the case where the shapes on the ejection hole 8*d* sides vary. However, by performing polishing, the precision of formation of the internal opening 8*c* sides can be made higher and the variation in the ejection characteristics can be reduced, therefore preferably polishing is carried out. The positive type photoresist film 204 can be formed by the same technique as that for the negative type photoresist film 104.

Figure 7G:
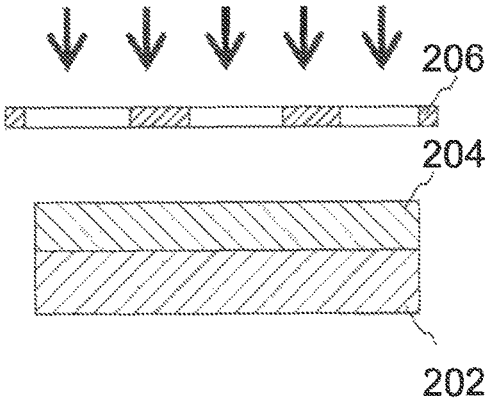
Figure 7H:
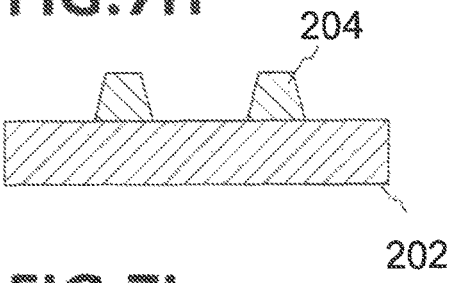

In FIG. 7G, the photomask 206 is designed to block light only at the portions corresponding to the nozzles 8 in the photomask 206. The parts of the photoresist film 204 under the other portions where the light is passed are dissolved and removed. In the same way as the previous manufacturing process of the nozzle plate 31 using the negative type photoresist, the light passed through the photomask 206 spreads inwardly from the light shielding portions due to the phenomenon of light diffraction. In the vicinities of the boundaries of the light shielding portions, the light becomes weaker by the amount of the diffraction light which spreads toward the inside, therefore the amount of sensitization of the photoresist film 204 is lowered. Basically, the larger the distance from the photomask 206, the larger the influence by this. That is, the further from the photomask 206, gradually the narrower the range of dissolution and removal. Due to this, as shown in FIG. 7H, the shapes for forming the tapered parts 8*a* are formed.

Figure 7I:
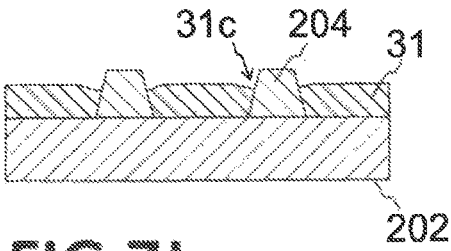

In FIG. 7I, the plating film 31 is formed in the same way as the manufacturing process using the negative type photoresist. Although the explanation was omitted in the negative type production method, in the vicinity of the photoresist film 204, the speed of formation of the plating film 31 becomes slower than that at its periphery. For this reason, even if the plating film 31 is formed for the same time, in the vicinity of the photoresist film 204, the plating film 31 becomes thinner. Therefore, curved parts 31*c* in which the thickness of the plating film 31 becoming gradually thinner toward the photoresist film 204 are formed.

In the negative type process, the upper surface of the plating film 31 in FIG. 7I becomes the ejection hole surface 31*a*. That is, the inversely tapered part 8*b* is formed predicated on the curved portion 31*c*. The curved portion 31*c* exhibits an inversely tapered shape where the cross-sectional area being larger toward the ejection hole surface 31*b*. However, by just managing the process conditions of the plating film 31, it is difficult to form the curved portion 31*c* with such a high precision that the width T in the curved portion 31*c* is contained within the desired dimensional range.

Therefore, after the residue of the photoresist film 204 is removed and the nozzle plate 31 is peeled off from the electroforming substrate 202, the nozzle plate 31 is polished from the curved part 31*b* side, that is, the ejection hole 8*b* side. This polishing can be carried out by lapping, buffing, chemical polishing, electrolytic polishing, or other various techniques. By adjusting the amount of polishing according to the location of the nozzle plate 31, the widths T of the curved portion 31*c* can be adjusted. The curved portion 31*c* which remains after polishing becomes the inversely tapered parts 8*b*.

Figure 7J:
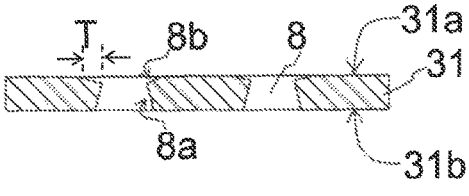

In the nozzle plate 31 processed in this way, as shown in FIG. 7J, the nozzles 8 each having the tapered part 8*a* on the lower side in the drawing and having the inversely tapered part 8*b* on the upper side in the drawing are formed. Then, by adjusting the polishing amount according to the location in the nozzle plate 31, the widths T of the inversely tapered parts 8*b* can be made different in magnitude in the nozzle plate 31.

Note that, the curved portion 31*c* is formed in the two positive type and negative type manufacturing processes. In the negative type process, the curved portion 31*c* is positioned on the ejection hole 8*d* side, therefore the influence due to the variation in the shape of the curved portion 31*c* exerted upon ejection is large. For this reason, the width T of the inversely tapered part 31*b* is adjusted by performing polishing as explained above. In the positive type, the curved portion 31*c* is positioned on the internal opening 8*c* side, so the influence exerted upon the ejection is small compared with the negative type, therefore the shape of the curved portion 31*c* which varied may be left as it is as well. Further, the shape may be adjusted by polishing in the same way as that in the negative type or the curved portion 31*c* may be removed by polishing.

REFERENCE SIGNS LIST

1 . . . printer,
2 . . . liquid ejection head,
4 . . . channel member
5 . . . manifold
  5*a* . . . sub-manifold
  5*b* . . . opening of manifold
6 . . . individual supply channel
7 . . . nozzle arrangement region
  7*a* . . . center part (of nozzle arrangement region)
  7*b* . . . end part (of nozzle arrangement region)
  7*ba* . . . first end part (of nozzle arrangement region)
  7*bb* . . . second end part (of nozzle arrangement region)
8 . . . nozzle, through hole
  8*a* . . . tapered part
  8*b* . . . inversely tapered part
  8*c* . . . internal opening
  8*d* . . . ejection hole
9 . . . pressurizing chamber group
10 . . . pressurizing chamber

11*a*, 11*b*, 11*c*, 11*d* . . . columns of pressurizing chambers
12 . . . aperture
13 . . . head body
15*a*, 15*b*, 15*c*, 15*d* . . . columns of ejection holes
21 . . . piezoelectric actuator substrate
21*a* . . . piezoelectric ceramic layer (ceramic vibration plate)
21*b* . . . piezoelectric ceramic layer
22 to 30 . . . plates
31 . . . plate (nozzle plate), plating film
31*a* . . . ejection hole surface, first surface
31*b* . . . second surface
31*c* . . . curved part
32 . . . individual channel
34 . . . common electrode
35 . . . individual electrode
35*a* . . . individual electrode body
35*b* . . . extraction electrode
36 . . . connection electrode
50 . . . displacement element
70 . . . head mounting frame
72 . . . head group
80A . . . paper feed roller
80B . . . collection roller
82A . . . guide roller
82B . . . conveying roller
88 . . . control part
102, 202 . . . electroforming substrates
104, 204 . . . photoresist films
106, 206 . . . photomasks
A . . . nearest point
P . . . printing paper
T, T1*a*, T1*b*, T2*a*, T2*b* . . . widths of inversely tapered part

The invention claimed is:

1. A nozzle plate comprising:
a first surface from which the liquid is ejected, comprising:
at least one first region; and
at least one second region which is not superimposed on the first region;
a second surface on the opposite side to the first surface; and
a plurality of through holes which penetrate through the plate from the first surface to the second surface and become nozzles, comprising:
at least one first through hole disposed in the at least one first region; and
at least one second through hole disposed in the at least one second region, wherein
each of the through holes comprises an inversely tapered part where a cross-sectional area increases toward the first surface, on at least the first surface side the width T of the at least one first through hole is larger than the width T of the at least one second through hole, where the width of the inversely tapered part when viewed from the first surface side is defined as "T", and
a first thickness from the first region to the second surface is thinner than a second thicknesses from the second region to the second surface.

2. The nozzle plate according to claim 1, wherein the at least one second region comprises a plurality of second regions, the at least one second through hole comprises a plurality of second through holes, the at least one first region is located at a center part in a first direction of the first surface, and the plurality of second regions are located at the both end parts in the first direction of the first surface.

3. The nozzle plate according to claim 2, wherein
the absolute value of differences between TE1 and TE2 is not more than ⅕ of the mean value of TE1 and TE2, where one of the both end parts is a first end part, the other of the both end parts is a second end part, the width T in the first end part is TE1, and the width T in the second end part is TE2.

4. The nozzle plate according to claim 2, wherein
the absolute value of differences between DE1 and DE2 is not more than 1/20 of the mean value of DE1 and DE2, where one of the both end parts is a first end part, the other of the both end parts is a second end part, the thickness in the first end part is DE1, and the thickness in the second end part is DE2.

5. The nozzle plate according to claim 1, wherein the at least one first region comprises a plurality of first regions, the at least one first through hole comprises a plurality of first through holes, the at least one second region is located at a center part in a first direction of the first surface, and the plurality of first regions are located at the both end parts in the first direction of the first surface.

6. A liquid ejection head comprising:
a nozzle plate according to claim 1,
a plurality of pressurizing chambers individually linked with the plurality of through holes, and
a plurality of pressurizing parts individually applying pressure to the plurality of pressurizing chambers.

7. A recording device comprising:
a liquid ejection head according to claim 6,
a conveying part conveying a recording medium with respect to the liquid ejection head, and
a control part controlling the liquid ejection head.

* * * * *